US006194822B1

(12) United States Patent
Yeh et al.

(10) Patent No.: US 6,194,822 B1
(45) Date of Patent: Feb. 27, 2001

(54) ALIGNMENT OF ASYMMETRIC APERTURED GRIDS FOR ELECTRON GUN ASSEMBLY

(75) Inventors: Chun-Hsien Yeh, Taipei; Shung-Lin Chang; Chi-Tsan Wang, both of Taoyuan; Hsiang-Sung Lee, Taipei, all of (TW)

(73) Assignee: Chunghwa Picture Tubes, Ltd., Yangmei/Taoyuan (TW)

( * ) Notice: Subject to any disclaimer, the term of this patent is extended or adjusted under 35 U.S.C. 154(b) by 0 days.

(21) Appl. No.: 09/139,619

(22) Filed: Aug. 25, 1998

(51) Int. Cl.[7] ..... H01J 29/50

(52) U.S. Cl. ..... 313/409; 313/261; 313/417; 313/240; 313/456

(58) Field of Search ..... 313/409, 417, 313/438, 410, 456, 559, 242, 244, 252, 284, 240, 261, 265, 266, 267, 260; 445/33, 34

(56) References Cited

U.S. PATENT DOCUMENTS

| | | | | |
|---|---|---|---|---|
| 2,721,374 | * | 10/1955 | Pilas | 313/261 |
| 4,976,643 | * | 12/1990 | Lee | 313/261 |
| 5,430,350 | | 7/1995 | Chen et al. | 313/417 |

* cited by examiner

*Primary Examiner*—Ashok Patel
*Assistant Examiner*—Joseph Williams
(74) *Attorney, Agent, or Firm*—Emrich & Dithmar

(57) ABSTRACT

To prevent rotation of a generally flat, or planar, grid having three inline beam passing apertures, where the two outer apertures are asymmetric in shape, during assembly of a multi-beam electron gun for use in a color cathode ray tube (CRT), an electron gun alignment jig having three inline generally cylindrical mandrels in combination with a generally flat spacer plate is used. Each of the three mandrels is inserted in a respective grid aperture and the grid is placed in contact with the flat spacer plate. The flat spacer plate includes a recessed portion with an alignment slot. The grid includes a lateral alignment tab adapted for insertion in the spacer plate's matching alignment slot in a tight-fitting manner. With the alignment tab inserted in the alignment slot, the three inline apertures are in precise alignment in the alignment jig and grid rotation is prevented to facilitate electron gun assembly. Also to assist in grid alignment during electron gun assembly, a grid positioning jig includes a pair of spaced movable gripping elements each adapted to securely engage a respective lateral edge of the grid for positioning the grid in the electron gun assembly jig. In one embodiment, the positioning jig includes first and second spaced, inwardly urged gripping elements adapted for insertion in respective recessed portions, or notches, in opposed lateral edges of the grid. Apparatus for attaching the grid to the positioning jig includes a movable member in a mandrel for engaging the grid adjacent an asymmetric aperture.

17 Claims, 5 Drawing Sheets

ALIGNMENT OF ASYMMETRIC APERTURED GRIDS FOR ELECTRON GUN ASSEMBLY

FIELD OF THE INVENTION

This invention relates generally to multi-electron beam, multi-grid electron guns for use in color cathode ray tubes (CRTs) and is particularly directed to apparatus for properly aligning electron gun grids having eccentric beam passing apertures during electron gun assembly.

BACKGROUND OF THE INVENTION

Color CRTs as used in television receivers and computer terminals employ multiple electron beams for providing a video image comprised of the primary colors of red, green and blue on a display screen. Typically, three electron beams are directed onto and scan the display screen in a raster-like manner. A common color CRT design has the three electron beams arranged in an inline array. An electron gun in the color CRT typically employs plural cathodes for generating energetic electrons in combination with apertured, charged grids aligned along the electron gun's longitudinal axis. Each of the charged grids typically includes three inline beam passing apertures for forming the energetic electrons into three separate beams and for focussing the beams on the CRT's display screen.

In order to provide a high quality color video image on the CRT's display screen, each of the gun's charged grids must be in precise position and alignment along the electron gun's longitudinal axis. An alignment jig incorporating three spaced mandrels is typically used for positioning and aligning the grids during electron gun assembly. Where the three inline electron beam passing apertures are circular, cylindrically shaped mandrels are employed for engaging those portions of the grid defining the three inline apertures therein. The cylindrically shaped mandrels provide the requisite alignment precision of the grids necessary for electron gun assembly.

However, in some cases non-circular beam passing apertures are provided in the electron gun grid for improved video image quality. For example, the two outer electron beam passing apertures may be provided with an asymmetric, e.g., eccentric, shape to compensate for the asymmetric electrostatic field applied to the two outer electron beams. This asymmetric electrostatic field arises from the inline alignment of the three electron beams and the shape of the common lens portions of grids in the electron gun's main focus lens. The use of a cylindrical mandrel inserted in an asymmetric beam passing aperture typically gives rise to rotation of the grid during electron gun assembly. Rotation of the grid misaligns the grid's electron beam passing apertures resulting in a degradation of video image quality presented on the CRT's display screen.

The present invention addresses the aforementioned limitations of the prior art by providing for the precise alignment of grids having asymmetric beam passing apertures during electron gun assembly. The present invention also provides apparatus for the stable and secure positioning of electron gun grids during electron gun assembly.

OBJECTS AND SUMMARY OF THE INVENTION

Accordingly, it is an object of the present invention to facilitate the accurate positioning and alignment of asymmetric apertured grids in a multi-grid electron gun.

It is another object of the present invention to provide apparatus for preventing rotation of a grid having eccentric electron beam passing apertures during assembly in a multi-beam electron gun as used in a color CRT.

Yet another object of the present invention is to provide a support mechanism for securely maintaining an electron gun grid in fixed position during electron gun assembly.

This invention contemplates an alignment jig for aligning a grid during assembly of an electron gun, wherein the grid includes three inline electron beam passing apertures including a center circular aperture and two outer asymmetric apertures, the alignment jig comprising a first support member; three generally cylindrical mandrels attached to and arranged in a spaced, parallel, inline array on the support member, wherein each of the mandrels is adapted for insertion in a respective aperture of the grid for supporting the grid during electron gun assembly; a first keying member disposed on the grid; and a second support member adapted to receive the grid, the second support member including a second keying member adapted for complementary engagement with said first keying member for maintaining the three apertures of the grid in precise alignment with the three mandrels.

This invention further contemplates an arrangement for engaging and maintaining a grid in fixed position during assembly in an electron gun, wherein the grid is generally rectangular in cross section having first and second opposed lateral walls, the arrangement comprising first and second grooves respectively disposed in respective outer portions of the first and second lateral walls of the grid; a support frame; and first and second engaging mechanisms attached to the support frame, wherein the first and second engaging mechanisms are inwardly biased by an inwardly directed force and are adapted for insertion in the first and second grooves, respectively, for maintaining the grid in fixed position during electron gun assembly, and wherein the grid may be released and removed from the engaging mechanisms by overcoming the inwardly directed force.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawing, where like reference characters identify like elements throughout the various figures, in which:

DETAILED DESCRIPTION OF THE PREFERRED EMBODIMENTS

Figure 1:
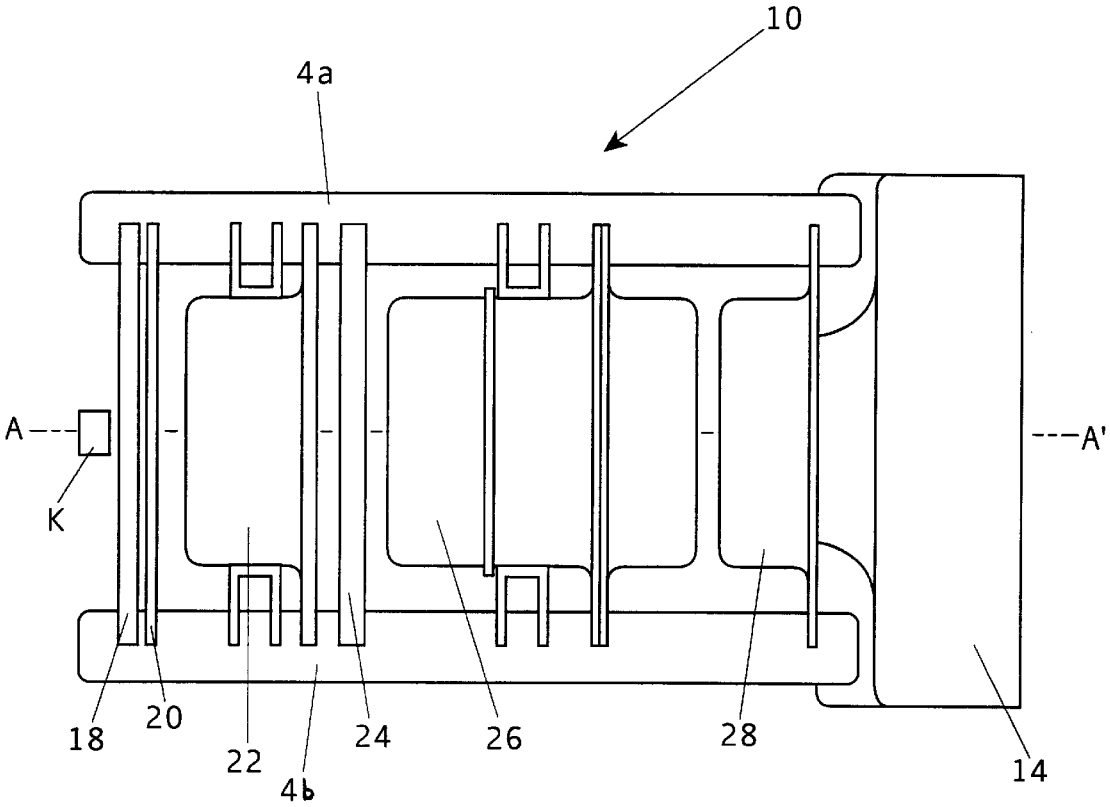
FIG. 1 is a side elevation view of a conventional electron gun with which the present invention is intended for use.

Referring to FIG. 1, there is shown a plan view of a conventional electron gun 10 with which the present invention is intended for use. Electron gun 10 includes a plurality of grids aligned along the longitudinal axis A–A' of the electron gun 10 in a spaced manner. Electron gun 10 also includes three inline cathodes K, with one cathode for each of the three electron beams. Only one cathode K is shown in the side elevation view of FIG. 1 for simplicity. Proceeding away from cathodes K, electron gun 10 next includes a G1 control grid 18 and a G2 screen grid 20, both of which are generally flat, or planar, in shape. Electron gun 10 next includes a G3 grid 22, a G4 grid 24, which is also is flat, a G5 grid 26, and a G6 grid 28. Each of the G1 control, G2 screen and G4 grids 18,20 and 24 includes three inline beam passing apertures, each for passing a respective electron beam, which are not shown in the figure for simplicity. Each of the G3, G5 and G6 grids 22,26 and 28 is generally cup-shaped and includes one or more sets of three inline beam passing apertures. Disposed adjacent the G6 grid 28, in proceeding rightwardly in the figure toward the CRT's display screen (not shown), is a shield cup 14. First and second elongated glass beads 4*a* and 4*b* are attached to opposed upper and lower portions of the grids as well as to the cathodes K and maintain the cathodes and grids in fixed relative position within the CRT's neck portion which is also not shown in the figure for simplicity. As described, electron gun 10 is conventional in design and operation. The present invention is employed during assembly of the electron gun 10 in ensuring that the aforementioned grids are in common alignment along the electron gun's longitudinal axis A–A'.

Figure 2:
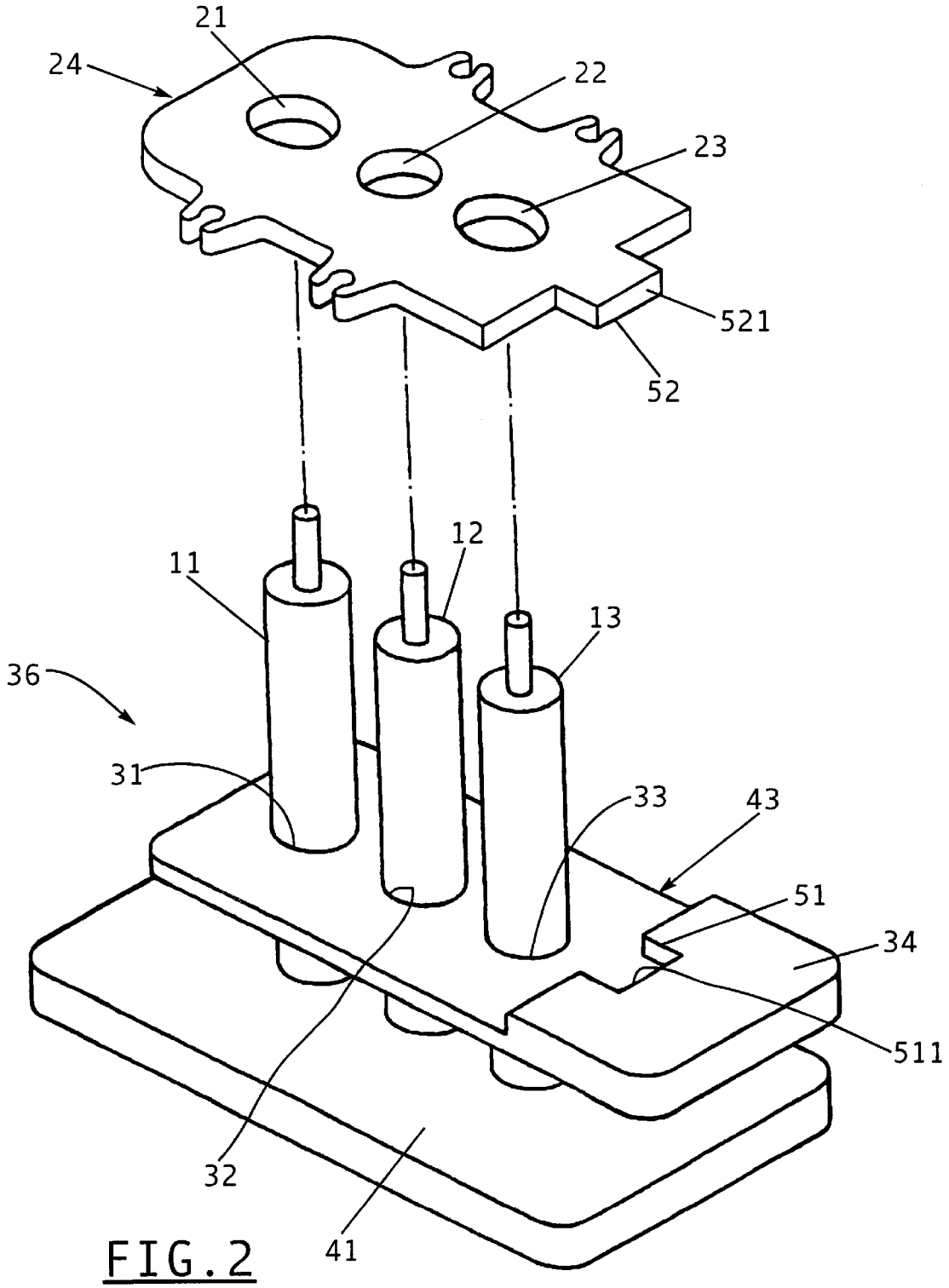
FIG. 2 is a perspective view of an alignment assembly in accordance with the present invention for use in aligning a grid with three inline apertures for installation in an electron gun.

Referring to FIG. 2, there is shown an alignment jig 36 for use in aligning electron gun grids during assembly of the electron gun. Alignment jig 36 includes a generally flat base plate 41 and three mandrels 11, 12 and 13 attached to a surface of and extending from the base plate. The mandrels 11, 12 and 13 are generally cylindrical in shape and are arranged on the base plate 41 in an equally spaced, parallel, inline array and extend generally transverse to the plan of the base plate.

Figure 3:
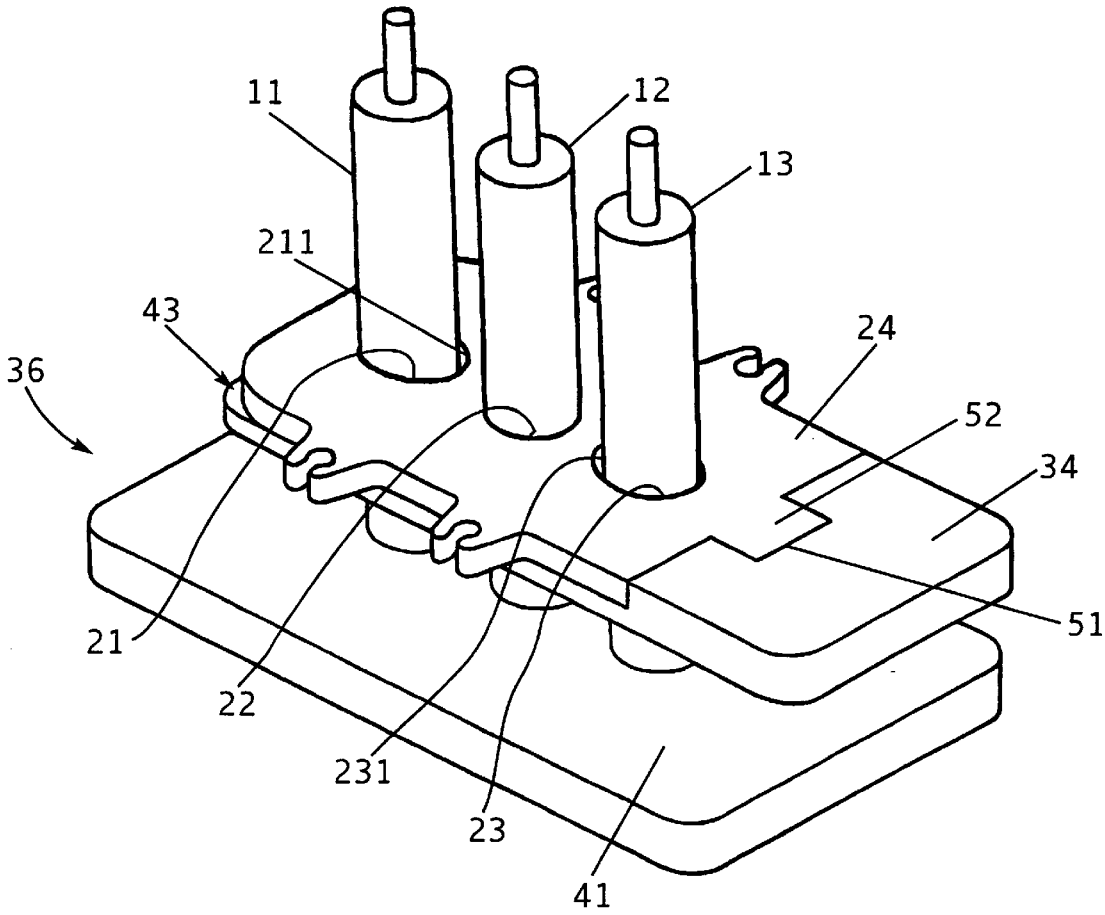
FIG. 3 shows the electron gun grid in position on the inventive grid alignment assembly.

Alignment jig 36 further includes a spacer plate 43 having three spaced, inline apertures 31, 32 and 33 therein. Each of the apertures 31, 32 and 33 is generally circular and is adapted to receive in tight-fitting engagement one of the aforementioned mandrels. Thus, mandrels 11, 12 and 13 are respectively positioned within spacer plate apertures 31, 32 and 33 and are connected to the spacer plate by conventional means such as an adhesive. Spacer plate 43 is also generally planar and includes an upraised end portion, or area, 34. The upraised portion 34 of the spacer plate 43 includes an alignment slot, or groove, 51 having a distal edge 511 which is arranged in facing relation to the three mandrels 11, 12 and 13. Also in accordance with the present invention, grid 24 which includes inline beam passing apertures 20, 22 and 23 is provided with an alignment tab 52 on a lateral edge thereof. Alignment tab 52 includes a distal edge 521 thereon. As shown in FIG. 2, the two outer electron beam passing apertures 21 and 23 are asymmetric, and more specifically are eccentric, in shape, while the center beam passing aperture 22 is circular. Mandrels 11, 12 and 13 are adapted for insertion in beam passing apertures 21, 22 and 23, respectively. With mandrels 11, 12 and 13 respectively inserted in beam passing apertures 21, 22 and 23 of grid 24 and with the grid positioned on the upper surface of spacer plate 43, the grid's alignment tab 52 is inserted within the spacer plate's alignment slot 51 in a tight-fitting manner. This is shown in FIG. 3, where grid 24 is positioned on the upper surface of spacer plate 43 and its alignment tab 52 is disposed within alignment slot 51. In this position, the alignment slot edge 511 is in intimate contact with the distal edge 521 of alignment tab 52, with the two remaining edges of the alignment slot and alignment tab also in intimate contact. Also as shown in FIG. 3, when grid 24 is positioned on the spacer plate 43, outer portions of the two outer mandrels 11 and 13 are positioned in contact with the outer circular portions of the two outer asymmetric apertures 21 and 23 in the electron gun grid. With each of the mandrels inserted in its respective beam passing aperture in grid 24, first and second gaps 211 and 231 are disposed respectively between mandrels 11 and 13 and the inner eccentric portions of beam passing apertures 21 and 23 as shown in FIG. 3. With mandrels 11, 12 and 13 respectively inserted in beam passing apertures 21, 22 and 23 and with the grid's alignment tab 52 inserted in the jig's alignment slot 51, rotation of grid 24 during electron gun assembly is prevented.

Figure 4:
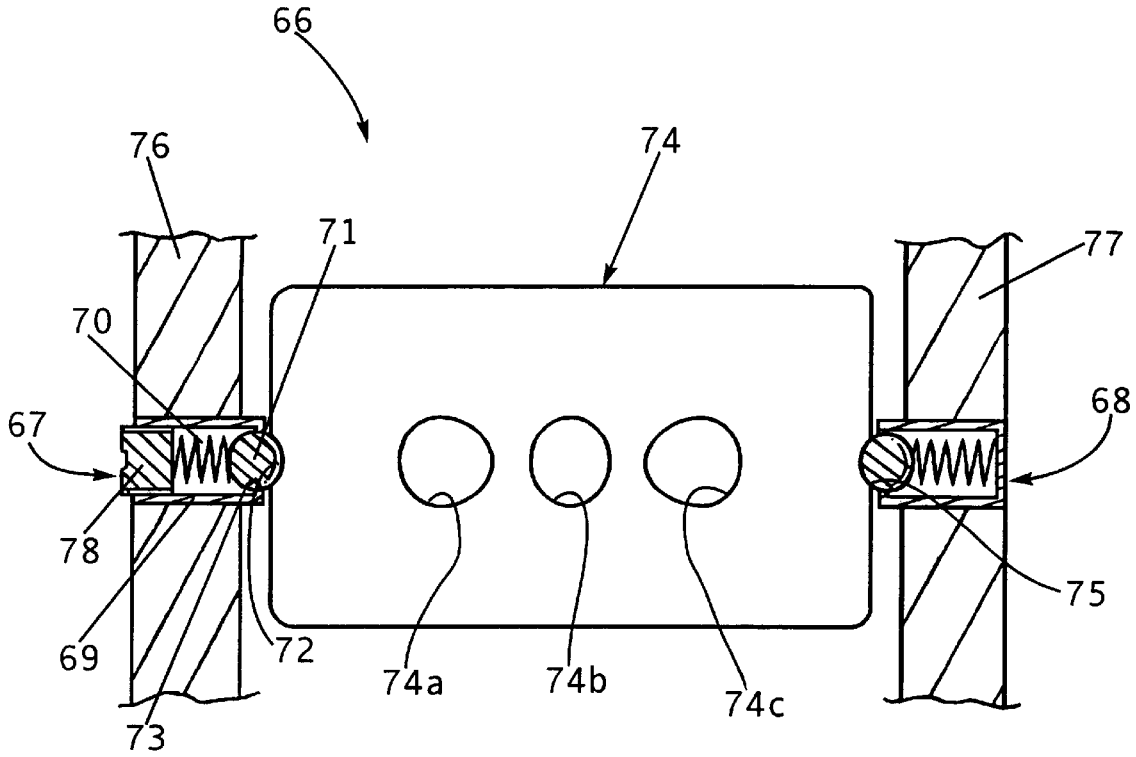
FIG. 4 is a sectional view of a support mechanism for maintaining an electron gun grid in fixed position during electron gun assembly.

Referring to FIG. 4, there is shown a sectional view of a positioning jig, or support mechanism 66, for maintaining an electron gun grid 74 in fixed position during electron gun assembly. Positioning jig 66 includes first and second spaced frame members 76 and 77. The first and second frame members 76,77 may be disposed in a unitary frame or may be coupled together in a conventional manner such as by using cross frame members (not shown). Disposed within the first and second frame members 76,77 and in mutual alignment are first and second engaging/retaining mechanisms 67 and 68. Each of the engaging/retaining mechanisms 67,68 is securely disposed within its respective frame member in a fixed manner. Electron gun grid 74 includes three inline beam passing apertures 74*a*, 74*b* and 74*c*, where the center aperture is circular and the two outer apertures are asymmetric, or more specifically eccentric. Details of the configuration and operation of the first engaging/retaining mechanism 67 will now be described, it being understood that the following description applies equally as well to the second engaging/retaining mechanism 68.

Engaging/retaining mechanism 67 includes a threaded tube, or pipe, 69 disposed within and extending through the first frame member 76. Tube 69 includes a threaded inner portion on the outer end thereof, and further includes an inner lip 73 on the inner end thereof. Disposed within and along the length of the threaded tube 69 is the combination of an adjusting screw 78, a coil spring 70, and a ball 71. Ball 71 is disposed on the inner end of the threaded tube 69 and is retained therein by the tube's inner lip 73. Adjusting screw 78 threadably engages the inner surface of the outer end of tube 69. Coil spring 70 is disposed between and engages adjusting screw 78 and ball 71. Coil spring 70 applies an outwardly directed force on ball 71, maintaining the ball within the threaded tube's inner lip 73. When urged outwardly from tube 69 by coil spring 70, ball 71 engages the tube's inner lip 73 and partially extends through an aperture within the tube's inner lip. By overcoming the biasing force of the coil spring 70, ball 71 may be displaced inwardly within and along the length of the threaded tube 69. By rotating the adjusting screw 78, the biasing force of coil spring 78 on ball 71 may be adjusted, as desired. Moving the adjusting screw 78 inwardly within threaded tube 69 increases the outwardly directed biasing force exerted on ball 71. Also in accordance with this aspect of the present invention, opposed lateral edges of electron gun grid 74 are provided with respective grooves, or slots, 72 and 75. Groove 72 is adapted to receive in secure engagement ball 71 of the first engaging/retaining mechanism 67, while opposing groove 75 is adapted to receive the ball of the second engaging/retaining mechanism 68 in tight fitting, secure engagement. The first and second engaging/retaining mechanisms 67,68 thus provide for the stable, fixed positioning of electron gun grid 74 during electron gun assembly in a secure releasable manner.

Figure 5:
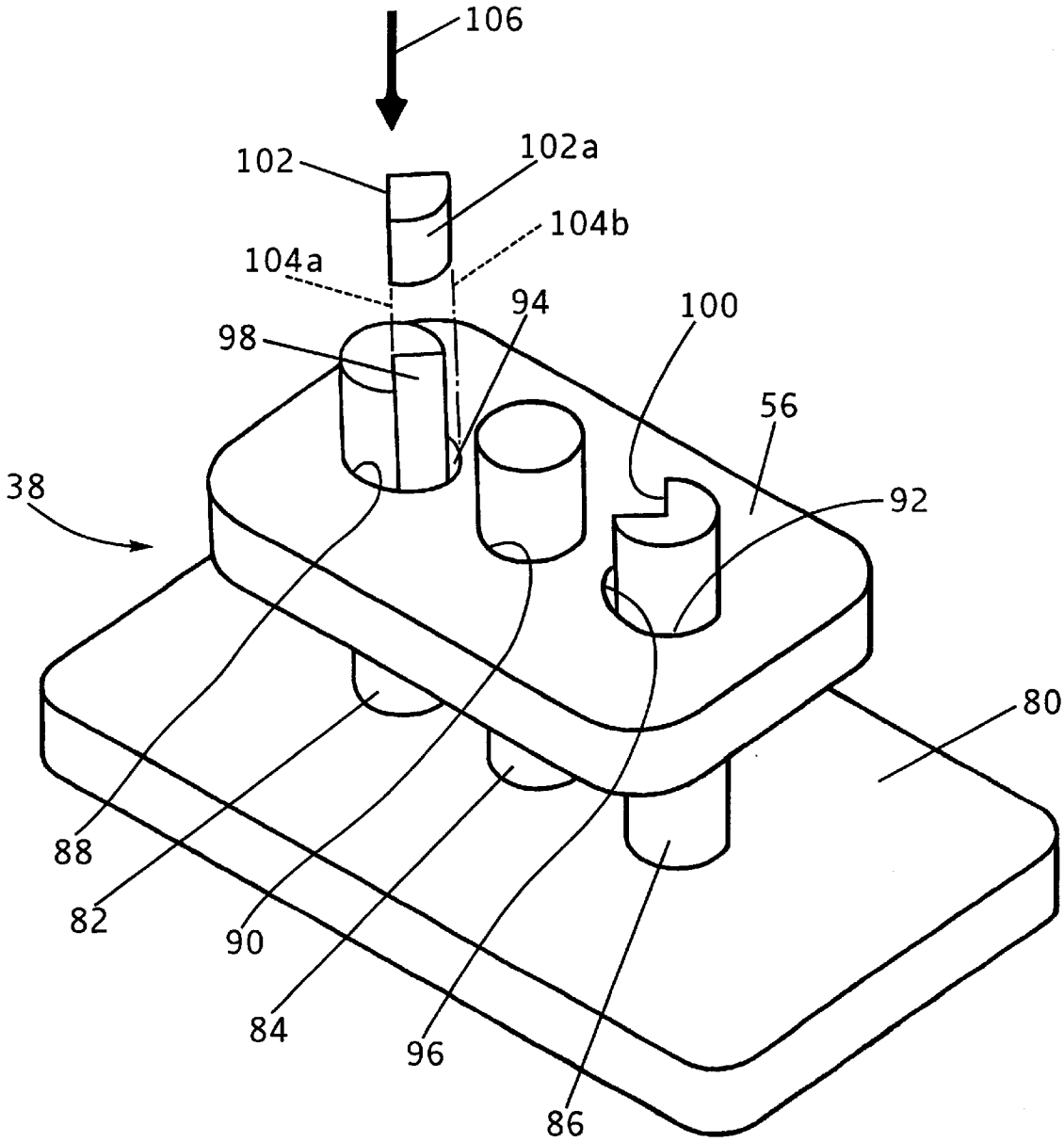
FIG. 5 is a perspective view of an arrangement for positioning a grid having eccentric electron beam passing apertures on the support mechanism of FIG. 4 for installation in an electron gun.

Referring to FIG. 5, there is shown a perspective view of another arrangement of an alignment jig 38 for positioning an electron gun grid 56 in precise alignment and preventing rotation of the grid during electron gun assembly. As in the previously described alignment jig 36 shown in FIGS. 2 and 3, the alignment jig 38 shown in FIG. 5 includes a base plate 80 to which are attached and from which extend three spaced, parallel mandrels 82,84 and 86. Each of the mandrels 82,84 and 86 is generally cylindrical in shape, with the two outer mandrels 82,86 respectively having first and second cutout portions 98 and 100. Mandrels 82,84 and 86 are adapted for insertion in respective inline beam passing apertures 88,90 and 92 of a generally planar electron gun grid 56. The center beam passing aperture 90 is generally circular and the two outer electron beam passing apertures 88,92 are asymmetric having eccentric inner portions in facing relation to the center aperture. The eccentric inner portions of the two outer electron beam passing apertures 88 and 92 respectively form first and second eccentric gaps, or spaces, 94 and 96 with the inner portions of mandrels 82 and 86. In accordance with this embodiment of the invention, a sector insert 102 is inserted in the first cutout portion 98 of the first mandrel 82. The sector insert 102 is then displaced along the longitudinal axis of the mandrel 82 in the direction of arrow 106 and is positioned within the first eccentric gap 94 between the first mandrel 82 and the inner, eccentric portion of beam passing aperture 88. The sector insert 102 is provided with a curvilinear, eccentric outer] surface for engaging the inner eccentric portion of beam passing aperture 88. With sector insert 102 positioned within the first cutout portion 98 of the first mandrel 82 and also disposed within the eccentric gap 94 of the first beam passing aperture 88, the electron gun grid 56 is prevented from rotating during electron gun assembly.

Sector insert 102 may also be positioned within the second cutout portion 100 of the third mandrel 86 and inserted in the second eccentric gap 96 of beam passing aperture 92 to prevent rotation of grid 56 during electron gun assembly. Finally, a sector insert may be inserted in each of the first and second cutout portions 98,100 of the first and third mandrels 82,86 to prevent rotation of grid 56 during electron gun assembly. A sector insert may be inserted in the cutout portion of a mandrel either manually by hand or automatically by machine. Following assembly of the grid in the electron gun, the sector insert is removed from the mandrel as well as from the electron beam passing aperture of the grid, either manually or automatically by machine.

There has thus been shown apparatus for precisely aligning a grid having asymmetric beam passing apertures and for preventing rotation of the grid during electron gun assembly. In one embodiment, the alignment and positioning apparatus is provided with a spacer plate for receiving the grid. The spacer plate is provided with a keyed portion adapted to receive a complementary keyed portion of the grid to precisely align the grid and prevent its rotation during electron gun assembly. In another embodiment, a mandrel inserted in an asymmetric electron beam passing aperture of the grid is provided with a cutout portion. A sector insert is inserted in the mandrel's cutout portion and within the asymmetric portion of the beam passing aperture so that the mandrel and sector insert combination engage that portion of the grid defining the electron beam passing aperture. With the mandrel and sector insert combination inserted in the asymmetric aperture and engaging the grid, rotation of the grid during electron gun assembly is prevented. This invention also contemplates a positioning jig for positioning the electron gun grid on the aforementioned alignment jig during electron gun assembly. The positioning jig includes a pair of opposed engaging/retaining mechanisms adapted to engage opposed lateral edges of the grid. The engaging/retaining mechanisms are urged inwardly in engagement with the grid which can be removed from the positioning jig by overcoming the inwardly directed biasing force of the engaging/retaining mechanisms.

While particular embodiments of the present invention have been shown and described, it will be obvious to those skilled in the art that changes and modifications may be made without departing from the invention in its broader aspects. For example, while the grid is described as including an alignment tab and the spacer plate of the alignment jig is described as including a complementary alignment slot, the reverse arrangement will operate equally as well. Thus, the grid may be provided with an alignment slot and the alignment jig's spacer plate may be provided with an alignment tab. Other forms of keying arrangements such as complementary templates, an aperture and an insert rod, paired projections, etc., may also be used in aligning the grid with a member such as the disclosed spacer plate. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An alignment jig for aligning and preventing rotation of a grid during assembly of an electron gun for use in a color cathode ray tube (CRT), wherein said grid includes three inline electron beam passing apertures including a center circular aperture and two outer asymmetric apertures, said alignment jig comprising:

a first support member;

three generally cylindrical mandrels attached to and arranged in a spaced, parallel, inline array on said support member, wherein each of said mandrels is adapted for insertion in a respective aperture of the grid for supporting the grid during electron gun assembly;

a first keying member disposed on the grid; and a second support member adapted to receive the grid, said second support member comprising a generally flat plate and including a second keying member adapted for complementary engagement with said first keying member for maintaining the three apertures of the grid in precise alignment with said three mandrels.

2. The alignment jig of claim 1 wherein said second support member has an upraised portion including said second keying member.

3. The alignment jig of claim 2 wherein said second support member further includes three inline generally circular apertures each adapted to receive a respective mandrel.

4. The alignment jig of claim 3 wherein said first keying member comprises an alignment tab disposed on said grid and said second keying member comprises an alignment slot complementary in size and shape to said alignment tab for engaging the alignment tab in a tightfitting manner.

5. The alignment jig of claim 1 wherein said two outer asymmetric apertures each include a respective symmetric portion and a respective asymmetric portion, and wherein said first and third mandrels each inserted in a respective one of said outer apertures engage a symmetric portion of the outer aperture, and wherein said second mandrel is inserted in said center aperture in a tight fitting manner.

6. The alignment jig of claim 5 wherein the asymmetric portions of the two outer apertures are eccentric.

7. An alignment jig for aligning and preventing rotation of a grid during assembly of an electron gun for use in a color cathode ray tube (CRT), wherein said grid includes three inline electron beam passing apertures including a center circular aperture and first and second outer asymmetric apertures, said alignment jig comprising:

a support member;

first, second and third generally cylindrical mandrels attached to and arranged in a spaced, parallel, inline array on said support member, wherein said first, second and third mandrels are adapted for insertion respectively in said first outer, said center, and said second outer apertures of the grid for supporting the grid during electron gun assembly;

a cutout portion disposed in at least one of said first and third mandrels; and an insert member adapted for insertion in the cutout portion in at least one of said first and third mandrels for engaging a portion of the outer asymmetric aperture in which said first and third mandrels is inserted for aligning and preventing rotation of the grid during electron gun assembly.

8. The alignment jig of claim 7 wherein said two outer asymmetric apertures each include a respective symmetric portion and a respective asymmetric portion, and wherein said first and third mandrels inserted in a respective one of the two outer apertures engage a symmetric portion of the aperture, and wherein said insert member engages an asymmetric portion of the aperture.

9. The alignment jig of claim 8 wherein the asymmetric portions of the two outer apertures are eccentric and are oriented toward the center aperture, and wherein said insert member has an outer eccentric portion.

10. The alignment jig of claim 7 wherein the cutout portion of a mandrel and said insert member are in the general form of sectors.

11. An arrangement for engaging and maintaining a grid in fixed position during assembly in an electron gun, wherein said grid is generally rectangular in cross section having first and second opposed lateral walls, said arrangement comprising:

first and second grooves respectively disposed in respective outer portions of the first and second lateral walls of the grid;

a support frame; and first and second engaging mechanisms attached to said support frame, wherein said first and second engaging mechanism are inwardly biased by an inwardly directed force and are adapted for insertion in said first and second grooves, respectively, for maintaining the grid in fixed position during electron gun assembly, and wherein the grid may be released and removed from said engaging mechanisms by overcoming said inwardly directed force.

12. The arrangement of claim 11 wherein in each of said engaging mechanisms includes a respective movable member urged outwardly by a biasing member into engagement with a lateral wall of the grid.

13. The arrangement of claim 12 wherein each movable member comprises a ball disposed in an elongated, linear, hollow tube with said biasing member urging the ball outwardly from the tube into engagement with a lateral wall of the grid.

14. The arrangement of claim 13 wherein each biasing member comprises a coil spring disposed within said hollow tube and engaging said ball for urging the ball along a longitudinal axis of and outwardly from the hollow tube.

15. The arrangement of claim 14 wherein each tube includes an inner end lip for engaging and preventing the ball from being displaced from the tube by said coil spring.

16. The arrangement of claim 15 further comprising adjustable means for adjusting the magnitude of the force exerted on the ball by the coil spring.

17. The arrangement of claim 16 wherein said adjustable means includes a threaded rotatable member engaging the coil spring and threadably inserted in and engaging the hollow tube.

* * * * *